US007124450B2

(12) United States Patent
Davidson

(10) Patent No.: US 7,124,450 B2
(45) Date of Patent: Oct. 24, 2006

(54) FLUSHABLE PLUNGER COVER

(76) Inventor: Dennis Davidson, 58 Avalon Rd., Pennington, NJ (US) 08534

( * ) Notice: Subject to any disclaimer, the term of this patent is extended or adjusted under 35 U.S.C. 154(b) by 155 days.

(21) Appl. No.: 10/791,395

(22) Filed: Mar. 1, 2004

(65) Prior Publication Data

US 2004/0172749 A1 Sep. 9, 2004

Related U.S. Application Data

(60) Provisional application No. 60/452,034, filed on Mar. 5, 2003.

(51) Int. Cl.
*E03D 9/00* (2006.01)

(52) U.S. Cl. ..... 4/255.11; 150/161

(58) Field of Classification Search ..... 4/255.01, 4/255.11, DIG. 18; 383/1; 150/161, 165
See application file for complete search history.

(56) References Cited

U.S. PATENT DOCUMENTS

| | | | | | |
|---|---|---|---|---|---|
| 1,786,513 | A | | 12/1930 | Zuckerman | 15/104.93 |
| 2,232,088 | A | * | 2/1941 | Waters | 383/122 X |
| 2,526,750 | A | * | 10/1950 | Hollandsworth | 4/255.11 |
| 3,654,064 | A | * | 4/1972 | Laumann | 4/451 X |
| 3,762,454 | A | * | 10/1973 | Wilkins, Jr. | 383/1 |
| 3,763,502 | A | | 10/1973 | Laumann | 4/452 |
| 3,846,158 | A | | 11/1974 | Vasilyadis | 428/211.1 |
| 3,936,890 | A | | 2/1976 | Oberstein | 4/452 |
| 4,136,798 | A | * | 1/1979 | Oberstein | 4/452 X |
| 4,362,781 | A | | 12/1982 | Anderson | 428/291 |
| 4,372,447 | A | | 2/1983 | Miller | 206/812 |
| 4,523,347 | A | | 6/1985 | Tames | 15/104.94 |
| 4,601,081 | A | | 7/1986 | Sutton et al. | 15/104.94 |
| 4,930,942 | A | | 6/1990 | Keyes et al. | 406/49 |
| 5,033,130 | A | | 7/1991 | Dehaese | 4/452 |
| 5,099,527 | A | | 3/1992 | Roose | 4/255 |
| 5,149,159 | A | | 9/1992 | Bardes | 294/1.3 |
| 5,226,182 | A | | 7/1993 | Tucker | 4/452 |
| 5,473,789 | A | | 12/1995 | Oster | 15/104.94 |
| 5,778,458 | A | | 7/1998 | Speelman | 4/452 |
| 5,813,058 | A | | 9/1998 | Quigley et al. | 4/309 |
| 6,038,709 | A | | 3/2000 | Kent | 4/255.05 |
| 6,061,841 | A | | 5/2000 | Parviainen et al. | 4/245.9 |
| 6,420,284 | B1 | | 7/2002 | Myers et al. | 442/166 |
| 6,499,155 | B1 | | 12/2002 | Barrios | 4/661 |
| 6,564,399 | B1 | | 5/2003 | Teal | 4/661 |
| 6,594,831 | B1 | | 7/2003 | Pardo et al. | 4/300.3 |
| 6,607,226 | B1 | | 8/2003 | Poncy | 294/25 |
| 6,647,567 | B1 | | 11/2003 | Baldwin et al. | 4/661 |
| 2002/0054784 | A1 | | 5/2002 | Wolf | 401/282 |

* cited by examiner

*Primary Examiner*—Robert M. Fetsuga

(57) ABSTRACT

A flushable cover for a plunger with a layer of a flushable paper material and a layer of a film soluble in cold water. The cover is constructed to maintain integrity during use of the plunger, but at the same time being capable of being broken down in water.

17 Claims, 2 Drawing Sheets

FLUSHABLE PLUNGER COVER

RELATED APPLICATION

This application claims the benefit of provisional application Ser. No. 60/452,034, filed Mar. 5, 2003.

FIELD OF THE INVENTION

The present invention relates to a cover for a plunger, which is constructed to maintain integrity during use of the plunger, but is flushable once removed from the plunger and immersed in water.

BACKGROUND OF THE INVENTION

A plunger is typically used to unclog toilets or other plumbing fixtures. During use, the plunger typically must be immersed in water. It, therefore, becomes saturated with water and exposed to contaminants, such as urine, fecal matter, used toilet paper, etc. After use, the plunger is removed from the fixture, which typically results in potentially contaminated water dripping outside the fixture. It must also be cleaned, which further results in potential human contact with the contaminants.

SUMMARY OF THE INVENTION

The invention encompasses a cover for a plunger that keeps the plunger dry and clean during use, is flushable, and does not impede the function of the plunger.

The invention comprises a plunger cover having at least one layer of a flushable paper material and at least one layer of a film that is soluble in cold water. The flushable paper material is joined to the water soluble film to form a cover that maintains its integrity during use of the plunger, but is flushable after the plunger is removed from the cover. The cover is non-toxic so as not to cause difficulties in downstream wastewater treatment processes at a treatment facility or in a septic tank.

BRIEF DESCRIPTION OF THE DRAWINGS

For the purpose of illustrating the invention there is shown in the drawings various forms which are presently disclosed; it being understood, however, that this invention is not limited to the precise arrangements and instrumentalities particularly shown.

DETAILED DESCRIPTION OF THE INVENTION

Figure 1:
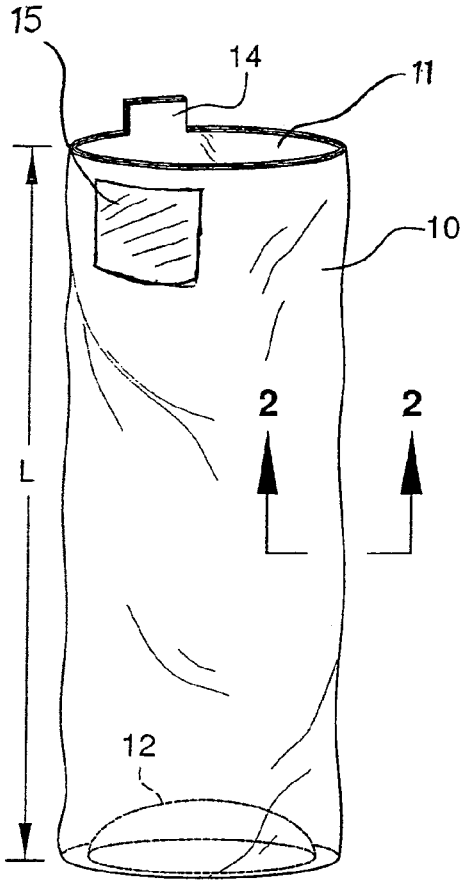
FIG. 1 is a perspective view of a flushable plunger cover according to an embodiment of the invention.

With reference to the drawings, where like numerals identify like elements, there is shown in FIG. 1 a flushable plunger cover 10 in accordance with an embodiment of the present invention.

As illustrated in FIG. 1, the flushable plunger cover 10 is tubular in shape with an open top end 11, and a closed concave bottom end 12. The concave bottom 12 allows a plunger cup 26 (not shown in FIG. 1) to achieve the required seal with the outlet of a plumbing fixture for effective plunging.

If desired, the cover 10 may have a tab 14 extending from the open end 11 to aid in removing the cover 10 after use. The tab 14 helps a user grip the cover 10 while a plunger is inserted or removed from the cover 10. The tab 14 may have other configurations, such as a semi-circle, a square, a triangle, a handle, and so on. It may also be configured in different widths and lengths.

Also if desired, a grip area 15 may be provided on the body of the cover 10. The grip area 15 also comprises a flushable material, such as a film soluble in cold water, a flushable paper material, and so on. The grip area 15 provides additional strength at the location where a user grips the cover 10 during insertion and removal of a plunger. The added strength accommodates for stresses placed on the cover 10 during insertion and removal of the plunger.

Figure 2:
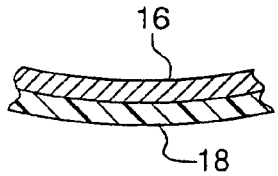
FIG. 2 is an enlarged cross section of the flushable plunger cover of FIG. 1, taken along the lines 2—2 in FIG. 1.

As shown in FIG. 2, the cover 10 comprises an inner layer of a flushable paper material 16 and an outer layer of a film 18 that is soluble in cold water. Although cold water solubility is preferred, it is not necessary. The layer of flushable paper material 16 provides stability to the cover 10, while the film 18 provides a substantially impermeable barrier that keeps a plunger dry and clean during use. The layers may be joined together by one or more of pressure, heat, adhesive, or other means recognized by one skilled in the art.

The flushable paper material 16 is preferably a material similar to that used in the manufacture of flushable paper toilet seat covers found in many public restrooms.

Alternate embodiments of the cover 10 have two or more layers of the flushable paper material 16 and one layer of the film 18. Other embodiments of the cover 10 have one layer of the flushable paper material 16 and two or more layers of the film 18. Still other embodiments of the cover 10 have two or more layers of the flushable paper material 16 and two or more layers of the film 18. Yet another embodiment of the cover 10 has three layers, an inner layer of the film 18, a middle layer of the flushable paper material 16, and an outer layer of the film 18. Any number of layers may be used without departing from the invention.

In the disclosed embodiment, the film 18 is a polyvinyl alcohol, available from such manufactures as AquaFilm, LLC. The preferred thickness of the film 18 is chosen to permit the film to dissolve completely in less than about two minutes. It is contemplated that, to achieve the desired dissolution rate, the preferred overall thickness of the film 18 is between 20 and 80 microns.

The dissolution rate of the film 18 may be controlled by changing the thickness of the film 18. The thicker the film 18, the slower the dissolution rate. Alternatively, multiple layers of the film 18 may be used to control the dissolution rate of the film 18. It is contemplated that multiple layers of the film 18 joined together may provide the same integrity and dissolution rate as the single layer, but with a smaller overall film thickness. The individual layers of a multi-layered embodiment may have thicknesses that are different from one another. There may be a thicker outer film combined with a thinner inner film, or a thinner outer film combined with a thicker outer film.

Different film composition may also be used. For example, a film with a high water solubility may be combined with a film with a lower water solubility.

Preferably, the film 18 is colored, although it may be transparent. A colored film 18 provides for a decorative appearance, and enables the cover 10 to function as a decorative cover for the plunger while storing the plunger between uses. This provides an added benefit to the user.

The film 18 may have printing on it, such as a product name or trademark. Any printing should be done with a non-aqueous ink. It is contemplated that a non-aqueous ink also may be used to retard or control the dissolution rate of the film 18. Thus, printing may be used not only to display information but to control the dissolution rate of the film 18. The greater the amount of non-aqueous ink used, the greater the effect on the dissolution rate of the film 18. In a multi-layered embodiment, the ink may be used on an inner layer in combination with a transparent outer layer so that the transparent outer layer dissolves first, leaving the printing intact for a longer period of time.

The dissolution rate of the film 18 may also be retarded or controlled by coating the film 18 with latex or other similar material. The coating of latex or other similar material must, of course, be of such composition and thickness that the coating will eventually break down into flushable pieces when immersed in water. As with the non-aqueous ink, the coating of latex or other similar material may be transparent or colored.

Figure 3:
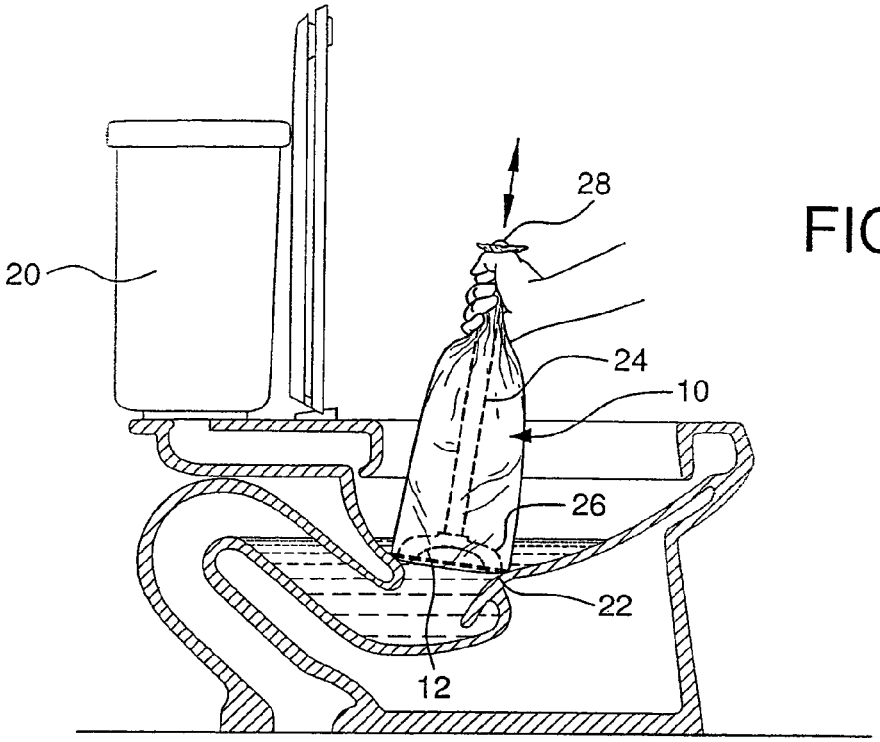
FIG. 3 is a side elevation view of a flushable plunger cover according to an embodiment on the invention, substantially enclosing a plunger being used to unclog a toilet.

FIG. 3 shows a user plunging a toilet 20 with a plunger 24 protected by a flushable plunger cover 10. To use the cover 10, the user first slides the plunger 24 into the cover 10. The user then immerses the covered plunger in the toilet 20 and presses the cup 26 against the outlet 22. A seal between the cup 26 and the outlet 22 is required to achieve the full suction and compression force necessary for effective plunging. The film 18, while soluble, nonetheless is substantially non-permeable, and thus allows the required seal to be created between the cup 26 and the outlet 22.

Figure 4:
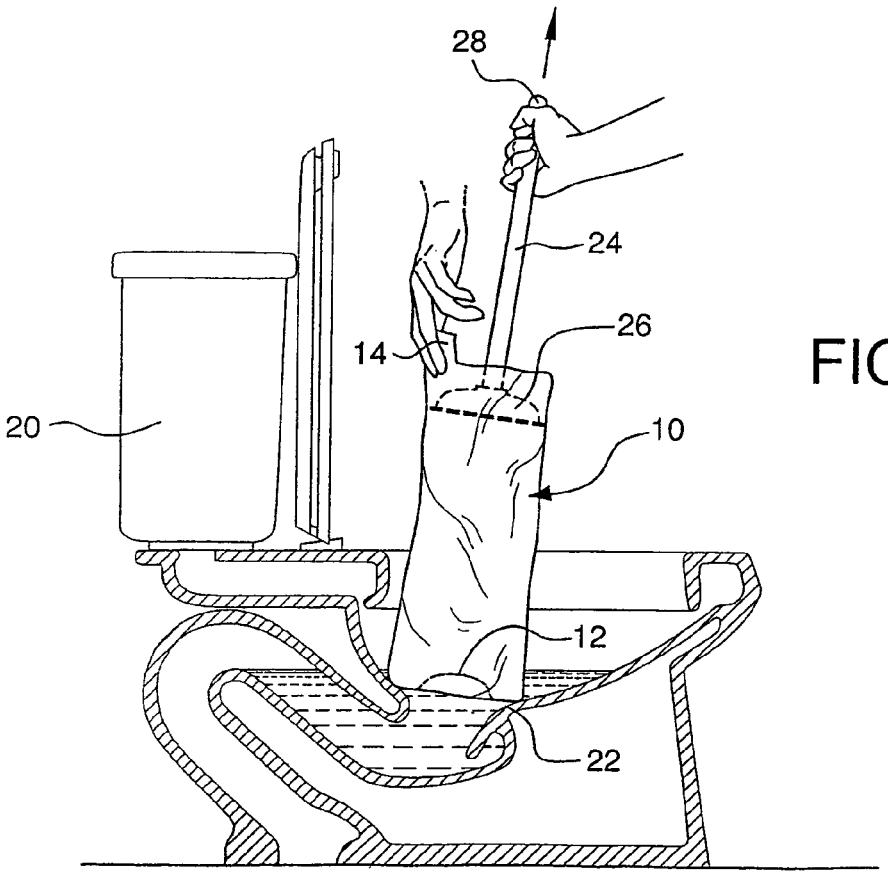
FIG. 4 is a side elevation view of a flushable plunger cover being removed from a plunger after use.

After use, the user, as shown in FIG. 4, grasps the tab 14 and removes the plunger 24 from the cover 10. The cover 10 remains in the toilet fixture 20. The film 18 is allowed to completely dissolve, after which time the dissolved film 18 and the flushable paper material 16 is flushed. Although the disclosed invention, as illustrated, depicts the plunger 24 and plunger cover 10 being used in a toilet fixture 20, the invention is not so limited. It is anticipated that a toilet fixture will likely be the most common use of the invention, but it is not the only use. Instead, the cover may be used to keep plungers dry and clean when unclogging sinks, tubs, shower stalls, and any other plumbing fixture with a drain outlet. After use with plumbing fixtures other than a toilet, the cover may be transported to a toilet, placed into the toilet, allowed to break down, and then flushed.

Figure 5:
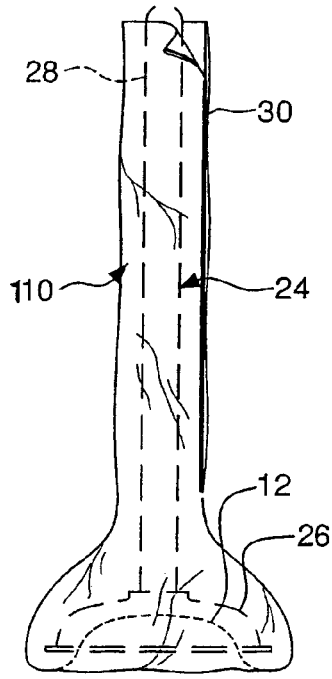
FIG. 5 is a side elevation view of a flushable plunger cover, according to another embodiment of the invention, with a resealable opening along one side.

FIG. 5 shows an embodiment of the cover 110 with a resealable side seam 30. In this embodiment, the plunger 24 is inserted into the cover 110 when the seam 30 is open. After the plunger 24 is inserted, the seam 30 is closed and the plunger 24 is then put to use. After use, the seam 30 is opened, and the plunger 24 is removed from the cover 110. The addition of a seam 30 allows the cover 110 to be more streamlined to the plunger handle 28, and uses less material.

The disclosed invention, as illustrated, depicts the cover being used with a standard plunger. However, the invention is not so limited. Alternate embodiments of the flushable cover of this invention, other than the ones shown, may be configured to conform to different plunger designs, such as a plunger with an accordion style cup, a plunger with a tapered cup, and so on. Alternate embodiments of the cover may have different lengths to accommodate for different plunger lengths. Alternate embodiments of the cover may have different bottom configurations, such as flat bottom, concave bottom, or convex bottom. The bottom configuration may be configured so that the bottom more easily seats with a concave surface of a plunger cup to enhance the seal between the cup and the plumbing outlet. The cover may be configured with various body configurations, such as tubular, tubular with a side seam, or tubular with a flared bottom. The cover body may also be shaped like a flat bag, a box, a cone, and so on.

The cover may be infused with one or more of a cleaner, disinfectant, or fragrance.

It will be appreciated by those skilled in the art, that the present invention may be practiced in various alternate forms and configurations. The previously detailed description of the disclosed embodiments are presented for purposes of clarity of understanding only, and no unnecessary limitations should be implied there from.

What is claimed is:

1. A plunger with a flushable plunger cover comprising: A rubber plunger with a plastic or wooden handle and a flushable cover containing the plunger with the cover comprising a layer of a flushable paper material joined to a layer of a film soluble in water; the layer of film and the layer of paper material being shaped to substantially enclosed a plunger and to maintain integrity during use of the plunger and to breakdown in water so that it is flushable after use.

2. The cover of claim 1 wherein the layer of the paper material and the layer of film are joined together by one or more of heat, pressure, or adhesive.

3. The cover of claim 1 wherein the cover comprises a single layer of paper material joined to a single layer of film.

4. The cover of claim 1 wherein the film is a polyvinyl alcohol.

5. The cover of claim 1 wherein the dissolution rate in water of the film is less than 2 minutes.

6. The cover of claim 1 wherein the film is transparent.

7. The cover of claim 1 wherein the film is coated with an ink.

8. The cover of claim 7 wherein the ink is a non-aqueous ink.

9. The cover of claim 1 wherein the cover has a concave bottom that substantially conforms to the concave plunger cup.

10. The cover of claim 1 wherein the cover is tubular with an open top end for receiving the plunger.

11. The cover of claim 1 wherein the cover has an open top end and a resealable seam along an axis substantially perpendicular to the open top end.

12. The cover of claim 1 wherein the cover has a grip area comprising at least one layer of a film soluble in water.

13. The cover of claim 1 wherein the cover has an open top end and a tab extending above the open end.

14. The cover of claim 13 wherein the tab comprises at least one layer of a film soluble in cold water.

15. The cover of claim 13 where in the tab is in the shape of one of a semi-circle, square, triangle and rectangle.

16. The cover of claim 1 wherein the cover is infused with at least one of a cleaner, disinfectant, or fragrance.

17. The cover of claim 1 wherein the cover comprises a single layer of paper material sandwiched between two layers of film.

* * * * *